US006398060B1

(12) United States Patent
Apostolides

(10) Patent No.: US 6,398,060 B1
(45) Date of Patent: Jun. 4, 2002

(54) PROTECTIVE APPARATUS FOR COOKWARE

(76) Inventor: John K. Apostolides, 605 Bending Oak La., Pittsburgh, PA (US) 15238

( * ) Notice: Subject to any disclaimer, the term of this patent is extended or adjusted under 35 U.S.C. 154(b) by 0 days.

(21) Appl. No.: 09/693,241

(22) Filed: Oct. 20, 2000

(51) Int. Cl.[7] ..... B65D 23/00

(52) U.S. Cl. ..... 220/573.1; 220/495.01; 220/574.3

(58) Field of Search ..... 220/573.1, 573.2, 220/573.4, 574.3, 495.03, 495.01; 383/907

(56) References Cited

U.S. PATENT DOCUMENTS 2,541,002 A * 2/1951 Wells ..... 338/907 X
2,771,668 A * 11/1956 Lindsey ..... 220/573.1
3,076,579 A * 2/1963 Kuhlman ..... 220/574.3
4,508,768 A 4/1985 Kornely et al.
4,828,134 A * 5/1989 Ferlanti ..... 220/573.1
5,048,688 A 9/1991 Hicks, Jr.
5,240,134 A * 8/1993 McDermott et al. ..... 220/495.01 X
5,941,408 A * 8/1999 Sherman ..... 220/495.01
6,056,147 A * 5/2000 Jarman ..... 220/495.01 X

* cited by examiner

*Primary Examiner*—Steven Pollard
(74) *Attorney, Agent, or Firm*—Kirkpatrick & Lockhart LLP

(57) ABSTRACT

A protective cover for protecting inner surfaces of cookware includes a non-selfsupporting surface that substantially overlies the inner surfaces. The protective cover may also include a handle portion attached to the non-selfsupporting surface that defines a handle opening for receiving a handle of the cookware and securing the protective cover to the cookware. Alternatively, the protective cover may include a non-selfsupporting enclosure defining an opening for receiving the cookware and protecting the inner surfaces and the outer surfaces of the cookware by substantially overlying the inner and outer surfaces thereof. A closure assembly for closing the opening of the non-selfsupporting enclosure is also included.

12 Claims, 3 Drawing Sheets

PROTECTIVE APPARATUS FOR COOKWARE

CROSS-REFERENCE TO RELATED APPLICATIONS

Not applicable.

FEDERALLY SPONSORED RESEARCH

Not applicable.

BACKGROUND OF THE INVENTION

1. Field of the Invention

The invention relates to cookware and, more particularly, to protective covers for protecting surfaces of cookware.

2. Description of the Invention Background

Cookware has existed for centuries in many different forms. Over time, cookware has become more technologically sophisticated due to advances, for example, in material sciences. Cookware is now developed from complex and expensive materials that enhance, for example, the thermal characteristics, the mechanical strength and the overall cooking quality of the cookware. Cookware may also include features for added benefit including, for example, a non-stick coating applied to the cooking surface.

In view of the nature of modern cookware, it is desirable to protect the cookware from damage or wear when not in use. Protection for cookware is particularly desirable in situations, as is known, where a plurality of pieces of cookware of decreasing size are stacked or "nested" for storing the cookware in a cabinet or the like. In the nested arrangement, an outer surface of a small piece of cookware typically is received in and contacts an inner or cooking surface of a large piece of cookware. This can result in damage or wear to the inner or cooking surface of the large cookware, and possibly damage or wear to the outer surface of the small cookware.

U.S. Pat. No. 5,048,688 discloses a scratch prevention pan liner having a lower surface configured for receipt in a first designated pan and a central recess on an upper surface for receipt of a second designated pan. The pan liner substantially fills the interior of the first designated pan and is generally configured for use with pans of a particular size. U.S. Pat. No. 4,508,768 discloses a protective liner for vessels, such as cooking pans, for protecting the interior surfaces thereof. The liner includes means for attaching an edge thereof to a rim of the vessel and means for holding the edge in place along the length of the rim.

Despite the existence of known protective covers for pans and the like, there remains a need for an improved protective cover that is simpler to use and manufacture, and more economical, both from a manufacturing and consumer purchase perspective, than known protective covers.

SUMMARY OF THE INVENTION

The invention meets the identified needs, as well as other needs, as will be more fully understood following a review of this specification and drawings.

In one embodiment, the invention includes a protective cover for cookware, the cookware having a base with an inner surface and a sidewall extending from the base, the sidewall having an inner surface, an outer surface and defining a cookware opening, the sidewall also having a handle extending outwardly from the outer surface thereof. The protective cover comprises a non-selfsupporting surface sized to substantially overlay the inner surface of the base and the inner surface of the sidewall to protect the inner surfaces of the cookware. The protective cover also comprises a handle portion attached to the non-selfsupporting surface and defining a handle opening, the handle of the cookware received in the handle opening to secure the protective cover to the cookware.

The invention may also include cookware of the type having a base with an inner surface and a sidewall extending from the base, the sidewall having an inner surface, an outer surface and defining a cookware opening, the sidewall having a handle extending outwardly from the outer surface thereof. The improvement comprises a protective cover for the cookware, wherein the protective cover comprises a non-selfsupporting surface sized to substantially overlay the inner surface of the base and the inner surface of the sidewall to protect the inner surfaces of the cookware. The protective cover also comprises a handle portion attached to the non-selfsupporting surface and defining a handle opening, the handle of the cookware received in the handle opening to secure the protective cover to the cookware.

The invention may further include a protective cover for cookware having a continuous inner surface and a handle extending from an outer surface of the cookware. The protective cover comprises a non-selfsupporting surface sized to substantially overlay the continuous inner surface of the cookware to protect the inner surface of the cookware. The protective cover also comprises a handle portion attached to the non-selfsupporting surface and defining a handle opening, the handle of the cookware received in the handle opening to secure the protective cover to the cookware.

In another embodiment, the invention includes a protective cover for cookware having a continuous inner surface and a handle extending from an outer surface of the cookware. The protective cover comprises a non-selfsupporting surface sized to substantially overlay the continuous inner surface of the cookware to protect the inner surface of the cookware. The non-selfsupporting surface defines a handle opening for receiving the handle of the cookware to secure the protective cover to the cookware.

In yet another embodiment, the invention includes a protective cover for cookware, the cookware having a base with an inner surface and an outer surface. The cookware also has a sidewall extending from the base, the sidewall having an inner surface, an outer surface and defining a cookware opening. The sidewall also has a handle extending outwardly from the outer surface thereof. The protective cover comprises a non-selfsupporting enclosure defining an opening for receiving the cookware, the non-selfsupporting enclosure sized to substantially overlay the inner and outer surfaces of the base and the inner and outer surfaces of the sidewall of the cookware to protect the cookware. The protective cover also comprises a closure for the opening of the non-selfsupporting enclosure.

The invention may also include cookware of the type having a base with an inner surface and an outer surface. The cookware also has a sidewall extending from the base, the sidewall having an inner surface, an outer surface and defining a cookware opening. The sidewall also has a handle extending outwardly from the outer surface thereof. The improvement comprises a protective cover for the cookware, wherein the protective cover comprises a non-selfsupporting enclosure defining an opening for receiving the cookware. The non-selfsupporting enclosure is sized to substantially overlay the inner and outer surfaces of the base and the inner and outer surfaces of the sidewall to protect the cookware. The protective cover also comprises means for closing the opening of the non-selfsupporting bag.

The invention may further include a protective cover for cookware having a continuous inner surface, a continuous outer surface and a handle extending from the continuous outer surface of the cookware. The protective cover comprises a non selfsupporting enclosure defining an opening for receiving the cookware, the non-selfsupporting enclosure sized to substantially overlay the continuous inner surface and the continuous outer surface of the cookware to protect the cookware. The protective cover also comprises a closure assembly adjacent the opening of the non-selfsupporting bag to close the non-selfsupporting bag.

The invention also includes a method of advertising comprising providing a protective cover for cookware, the protective cover comprising a non-selfsupporting surface sized to substantially overlay an inner surface of the cookware, and placing an identifying marking on the non-selfsupporting surface of the protective cover.

The invention further includes a method of advertising comprising providing a protective cover for cookware, the protective cover comprising a non-selfsupporting enclosure sized to substantially overlay an inner surface and an outer surface of the cookware, and placing an identifying marking on the non-selfsupporting enclosure of the protective cover.

Accordingly, the present invention provides solutions to the shortcomings of prior art protective apparatuses or covers for cookware. Those of ordinary skill in the art will readily appreciate, however, that these and other details, features and advantages will become further apparent as the following detailed description of the present preferred embodiments proceeds.

DETAILED DESCRIPTION OF THE INVENTION

Figure 1:
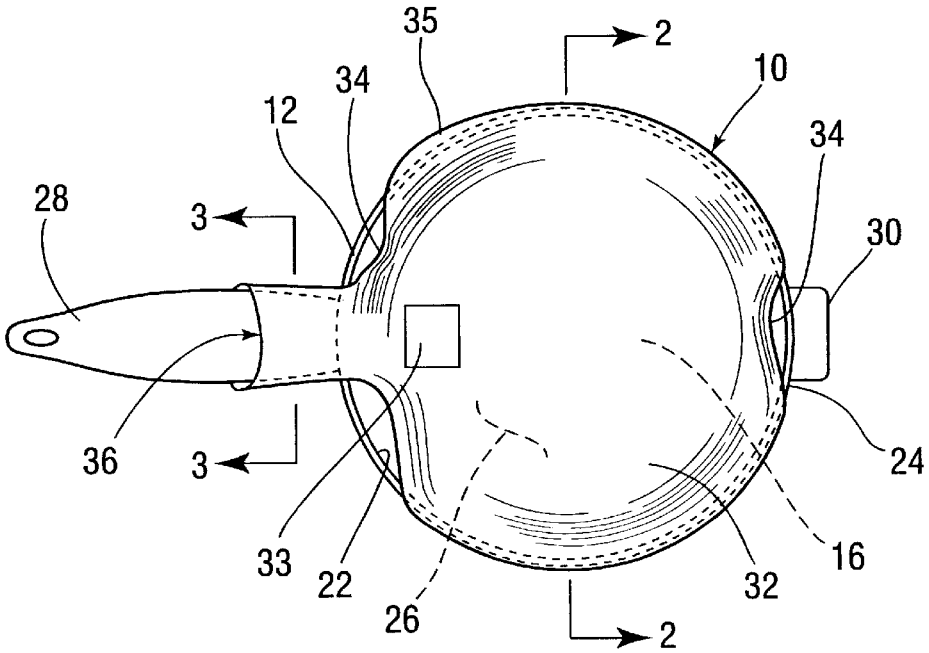
FIG. 1 is a top plan view of a protective cover of the invention as applied to cookware.
Figure 2:
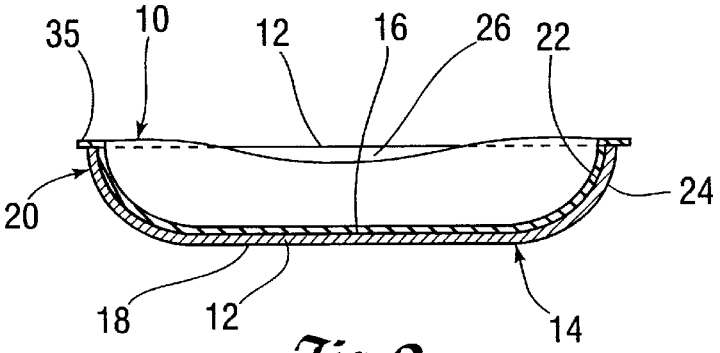
FIG. 2 is a cross-sectional view along line 2—2 of FIG. 1.

As used hereinabove and hereinafter, the term "cookware" generally refers to, for example, pots, pans, bowls, dishes, china, plates, service ware and the like of various sizes, shapes and configurations that may be constructed of various materials such as, for example, metal, metal alloys, glass, crystal, ceramic material, combinations thereof and like materials which are fragile or susceptible to damage by contact and/or wherein part or all of the surfaces thereof may be provided with a protective coating such as, for example, a non-stick coating material, as is generally known.

Referring to the drawings for purposes of illustrating the invention but not for purposes of limiting the same, FIGS. 1–4 illustrate a protective cover 10 for protecting one or more surfaces of an item of cookware 12. Specifically, the cookware 12 includes a base 14 having an inner surface 16 and an outer surface 18. The cookware 12 also includes a sidewall 20 extending from the base 14 and having an inner surface 22 and an outer surface 24. The sidewall 20 of the cookware 12 defines a cookware opening 26. The cookware 12 may also include a handle 28 extending generally outwardly from the outer surface 24 of the sidewall 20. The cookware 12 may also include an additional handle 30 that also extends generally outwardly from the outer surface 24 of the sidewall 20. It will be appreciated that additional handles disposed on or about the periphery of the cookware 12 may be provided, as desired. In addition, it will be appreciated that the inner surface 16 of the base 14 and the inner surface 22 of the sidewall 20 may be a continuous inner surface of the cookware 12 and forms a cooking surface. The inner surfaces 16 and 22, i.e., the cooking surface, may include, for example, a non-stick coating applied thereto, as is generally known. It will be further appreciated that the inner surfaces 16 and 22 which make up the continuous inner surface or cooking surface may be of various shapes and configurations, as is known for cookware.

Still referring to FIGS. 1–4, the protective cover 10 will now be described in more detail. The protective cover 10 comprises a non-selfsupporting surface 32 that substantially overlies the inner surface 16 of the base 14 and the inner surface 22 of the sidewall 20 to protect the inner surfaces of the cookware 12. By substantially overlying the inner surfaces 16 and 22, the non-selfsupporting surface 32 may be contained within the cookware 12, as illustrated at 34, or a portion of the non-selfsupporting surface 32 may extend outside of the cookware 12, as illustrated at 35. Accordingly, the non-selfsupporting surface 32 may be configured and arranged in the cookware 12 as desired and in accordance with the size and shape of the non-selfsupporting surface 32 relative to the size and shape of the cookware 12 and, more particularly, the size and shape of the inner surfaces 16 and 22.

As described, the protective cover 12 comprises a non-selfsupporting surface 32 which substantially overlies the inner surface 16 of the base 14 and the inner surface 22 of the sidewall 20, i.e., the cooking surface of the cookware 12. The non-selfsupporting surface 32 is flexible and easily conforms to a configuration of the inner surface 16 and the inner surface 22 to protect these surfaces from damage or wear. The non-selfsupporting surface 32 may be fabricated from, for example, cloth, linen, other soft woven fabrics, plastic, rubber, cotton, terry cloth, velvet, tarnish resistant material and the like materials.

Figure 3:
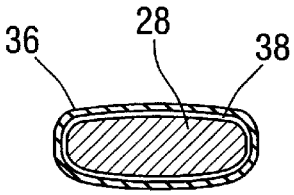
FIG. 3 is a cross-sectional view along line 3—3 of FIG. 1.

Referring to FIGS. 1 and 3, the protective cover 10 may also comprise a handle receiving portion 36. The handle receiving portion 36 may be integrally formed with the non-selfsupporting surface 32 and may be constructed of the same or similar materials as the non-selfsupporting surface 32. Specifically, the handle receiving portion 36 defines a handle opening 38 such that the handle 28 of the cookware 12 may be received in the handle opening 38. As can be appreciated, receipt of the handle 28 in the handle opening 38 provides for securing the protective cover 10 to the cookware 12. As can also be appreciated, the handle receiving portion 36 of the protective cover 10 provides for quick and simple installation and removal of the protective cover 10 with respect to the cookware 12.

The invention may also include providing or placing a logo, emblem, monogram, trademark, color coding (to identify for example a particular size) or other identifying symbol on the surface 32, as schematically represented by identifying marking 33 (FIG. 1). Employing the marking 33 can serve as a method of advertising for the manufacturer of the cookware 12 and/or the cover 10. It will be appreciated that the marking 33 can be strategically placed in various locations on the surface 32, and preferably the marking 33 is placed on an exterior surface of the surface 32 for easy viewing. The marking 33 may be secured or attached to the surface 32 using, for example, an adhesive or other known fastening means or the marking 33 could be integrally formed with the surface 32, for example, embroidered by lettering.

Figure 4:
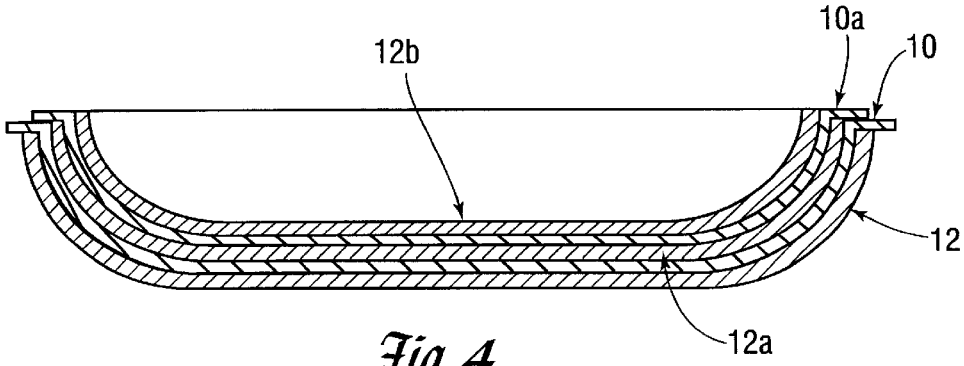
FIG. 4 is a cross-sectional view, similar to FIG. 2, illustrating multiple applications of the protective cover of the invention.

Referring to FIG. 4, application of the protective cover 10 and similar protective cover 10*a* to protect a plurality of pieces of cookware 12, 12*a* and 12*b* all arranged in a "nested arrangement" is illustrated. As can be appreciated, the protective covers 10 and 10*a* protect the inner and outer surfaces of the pieces of cookware 12, 12*a* and 12*b*. The protective covers 10 and 10*a* may be essentially identical in size while still serve to protect the surfaces of the pieces of cookware 12, 12*a* and 12*b* of varying sizes, or the protective covers 10 and 10*a* may be different in size to protect the surfaces of pieces of cookware of decreasing size.

Figure 5:
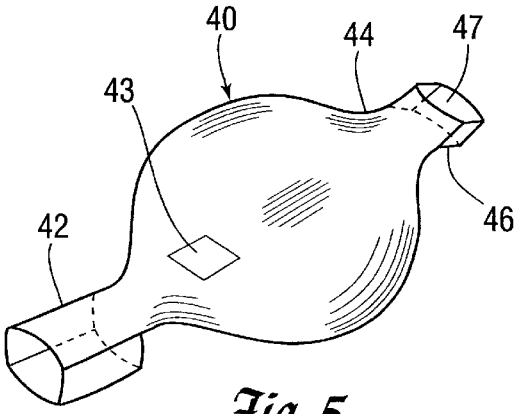
FIG. 5 is an isometric view of another embodiment similar to the protective cover shown in FIG. 1.

Referring to FIG. 5, there is shown another embodiment of the invention. Specifically, there is shown protective cover 40 for use in protecting the surfaces of cookware, such as cookware 12. The protective cover 40 includes a non-selfsupporting surface 41 and a handle portion 42 that is similar to the handle portion 36, illustrated in FIGS. 1 and 3, as described herein. In addition, the protective cover 40 includes an additional handle receiving portion 44 that defines an additional handle opening 46. The additional handle opening 46 is capable of receiving an additional handle of the cookware 12, such as additional handle 30. As can be appreciated, the additional handle portion 44 further secures the protective cover 40 to the cookware to be protected, such as cookware 12. The additional handle opening 44 may have an end 47 that is open to allow the additional handle 30 to extend therethrough or the end 47 may be closed to form a pocket for receipt of the additional handle 30. It will also be appreciated that the protective cover 40 is otherwise constructed similar to the protective cover 10, as described herein, and may include the marking 43 thereon.

Figure 6:
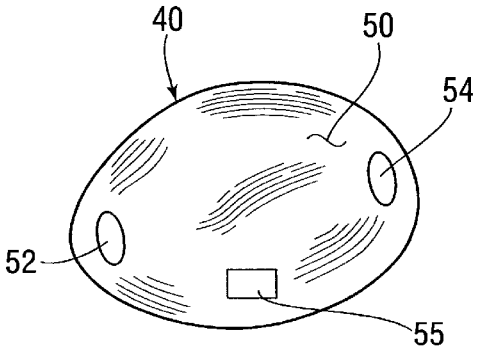
FIG. 6 is a top plan view of another embodiment similar to the protective cover shown in FIGS. 1–4 and FIG. 5.
Figure 6A:
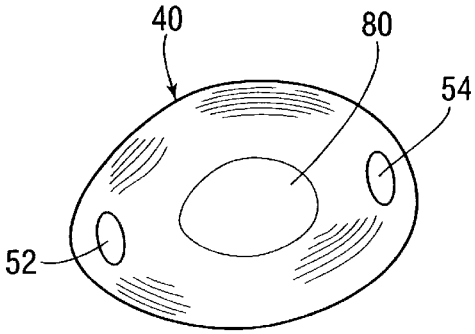
FIG. 6*a* is a bottom plan view of the protective cover shown in FIG. 6.

Referring to FIGS. 6 and 6*a*, there is shown a further embodiment of the invention. Specifically, protective cover 48 is provided for protecting the surfaces of cookware, such as cookware 12. The protective cover 48 includes a non-selfsupporting surface 50 that substantially overlies the continuous inner surfaces of the cookware to be protected. The non-selfsupporting surface 50 defines a first handle opening 52 for receiving a handle, such as handle 28 of cookware 12, to secure the protective cover 48 to the cookware being protected. The protective cover 48 may also include a second handle opening 54 for receiving an additional handle, such as handle 30 of cookware 12, for further securing the protective cover 48 to the cookware being protected. A marking 55 may also be included on the protective cover 48. The protective cover 48 may further include a non-slip surface 80 on a side thereof such that the non-slip surface 80 will engage the inner surface of the cookware to minimize slippage or movement of the protective cover 48 once in place in the cookware. The non-slip surface 80 may cover at least a portion of a side of the protective cover 48. The non-slip surface 80 may be formed by attaching a rubberized or rubber-coated material to, or integrally forming with, the cover 48 (particularly when the cover is formed from other than a rubber or other non-slip material, using an adhesive or similar known means for attachment.

Figure 6B:
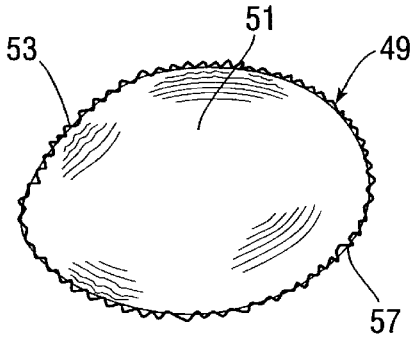
FIG. 6*b* is a top plan view of another embodiment similar to the protective cover shown in FIG. 6.

Referring to FIG. 6*b*, there is shown a further embodiment of the invention. Specifically, protective cover 49 is provided for protecting the surfaces of cookware, such as cookware 12. The protective cover 49 includes a non-selfsupporting surface 51 that overlies the continuous inner surfaces of the cookware to be protected. The protective cover 49 includes an elastic portion 53 adjacent an outer periphery 57 thereof such that when the protective cover is placed on or over the cookware 12, the elastic portion 53 engages the outer surface 18 adjacent the cookware opening 26 to secure the protective cover 49 to the cookware 12. The elastic portion 53 may extend partially or entirely about the outer periphery 57 of the protective cover 49. The elastic portion 53 may be formed, for example, by attaching an elastic band or other suitable member having sufficient elasticity or resiliency, to the outer periphery 57 using, for example, an adhesive for attaching the elastic band or other member thereto or by enclosing the elastic band or other member within the outer periphery 57 and sewing the same closed.

Figure 7:
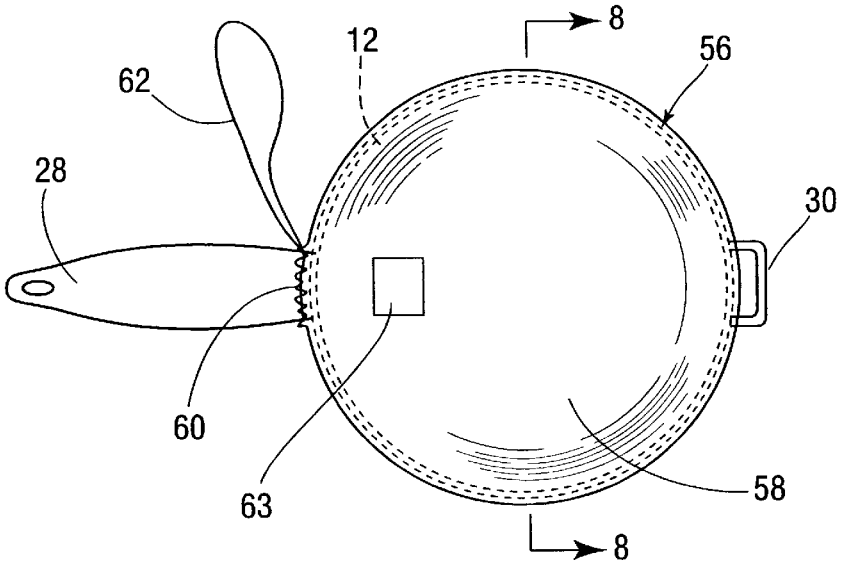
FIG. 7 is a top plan view of another embodiment of protective cover of the invention as applied to cookware.
Figure 8:
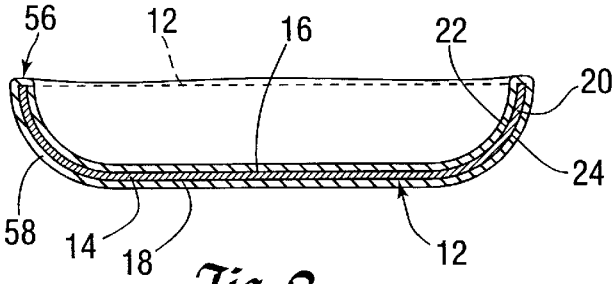
FIG. 8 is a cross-sectional view along line 8—8 of FIG. 7.
Figure 9:
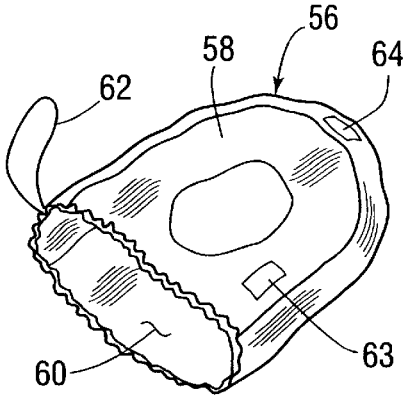
FIG. 9 is an isometric view of the protective cover shown in FIG. 7.

Referring to FIGS. 7–9, there is illustrated another embodiment of a protective cover for cookware, such as the cookware 12 as described herein, in accordance with the invention. Specifically, a protective cover 56 comprises a non-selfsupporting enclosure 58 that defines an opening 60 for receiving the cookware 12. The cookware 12 may be inserted into the non-selfsupporting enclosure 58 when the opening 60 is in an open position, as shown in FIG. 9, and then the opening 60 may be closed using a closure for closing the opening 60 of the non-selfsupporting enclosure 58, such as, for example, drawstring 62. FIG. 7 illustrates the non-selfsupporting enclosure 50 in a closed position with the handle 28 extending outwardly from the closed opening 60. Advantageously, closure of the non-selfsupporting enclosure 58 about the cookware 12 serves to protect the cookware 12.

The invention may also include providing or placing a logo, emblem, monogram, trademark or other identifying symbol on the enclosure 58, as schematically represented by identifying marking 63 (FIGS. 7 and 9). Employing the marking 63 can serve as a method of advertising for the manufacturer of the cookware 12 and/or the cover 56. It will be appreciated that the marking 63 can be strategically placed in various locations on the enclosure 58, and preferably the marking 63 is placed on an exterior surface of the enclosure 58 for easy viewing. The marking 63 may be secured or attached to the enclosure 58 using, for example, an adhesive or other known fastening means or the marking 63 could be integrally formed with the enclosure 58, for example, by embroidered lettering.

In order to protect the cookware 12, the non-selfsupporting enclosure 58 substantially overlies the inner surface 16 and the outer surface 18 of the base 14 and the inner surface 22 and the outer surface 24 of the sidewall 20. In other words, the non-selfsupporting enclosure 58 substantially overlies both the inner surfaces 16 and 22 and the outer surfaces 18 and 24 of the cookware 12. Preferably, the inner surfaces 16 and 22 are continuous and constitute the cooking surface of the cookware 12. In addition, the outer surfaces 18 and 24 are preferably continuous. As can be appreciated, the non-selfsupporting enclosure 58 by substantially overlying the inner and outer surfaces of the cookware 12 serves to protect the entire cookware from damage or wear.

As can be appreciated, by constructing the protective cover 56 of a non-selfsupporting enclosure 58, the non-selfsupporting enclosure 58 conforms to a configuration of the inner surface 16 and outer surface 18 of the base 14 and conforms to the inner surface 22 and the outer surface 24 of the sidewall 20. The flexibility of the non-selfsupporting enclosure 58 facilitates the non-selfsupporting enclosure 58 conforming to the particular size, shape and configuration of the cookware being protected. The non-selfsupporting enclosure 58 may be fabricated from a material including, but not limited to, for example, those listed above for fabricating the non-selfsupporting surface 32. It will also be appreciated that the non-selfsupporting enclosure 58 easily accommodates the nesting or stacking of items of cookware, as previously discussed and illustrated in FIG. 4.

As shown in FIG. 9, the non-selfsupporting enclosure 58 may also define an additional opening 64 for receiving an additional handle, such as handle 30 which extends from the outer surface of the sidewall 20 of the cookware 12. The additional opening 64, in combination with the opening 60, allows for the convenient handling of larger items of cookware while the cookware is retained in the non-selfsupporting enclosure 58. As can be appreciated, the handle 28 and the additional handle 30 both remain substantially outside of the non-selfsupporting enclosure 58 for grasping of the handles.

Figure 10:
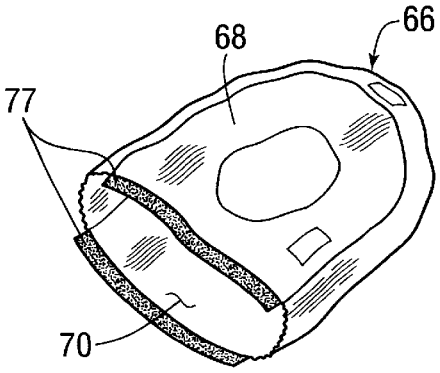
FIG. 10 is an isometric view of another embodiment of the protective cover shown in FIG. 9.

Referring to FIG. 10, another embodiment of the invention is shown. Specifically, protective cover 66 includes a non-selfsupporting enclosure 68 having an alternative means for closing the opening 70 defined by the non-selfsupporting enclosure 68. Specifically, disposed adjacent the opening 70 are hook and loop fasteners 77, such as, for example, Velcro® fasteners, for closing the non-selfsupporting enclosure 68. Otherwise, the non-selfsupporting enclosure 68 is similar in construction and function to the non-selfsupporting enclosure 58, as described herein.

Figure 11:
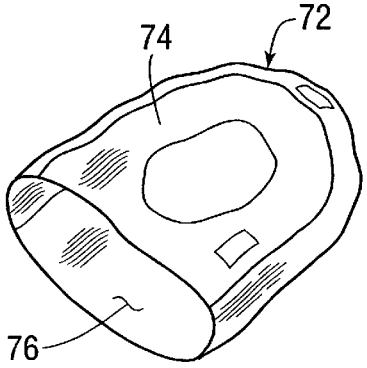
FIG. 11 is an isometric view of another embodiment of the protective cover shown in FIG. 9.

Referring to FIG. 11, there is shown yet another embodiment of the invention. Specifically, protection cover 72 comprises a non-selfsupporting enclosure 74 which defines an opening 76 for receipt of cookware, such as cookware 12. The non-selfsupporting enclosure 74 does not include a closure for closing the opening 76. The non-selfsupporting enclosure 74 may be employed when it is not desirable to close the opening using the means for closing, as described herein.

Whereas particular embodiments of the invention have been described herein for the purpose of illustrating the invention and not for the purpose of limiting the same, it will be appreciated by those of ordinary skill in the art that numerous variations of the details, materials and arrangement of parts may be made within the principle and scope of the invention without departing from the invention as described in the appended claims.

What is claimed is:

1. A protective cover for cookware, the cookware having a base with an inner surface and a sidewall extending from the base, the sidewall having an inner surface, an outer surface and defining a cookware opening, the sidewall having a handle extending outwardly from the outer surface thereof, the protective cover comprising:

a non-selfsupporting surface sized to substantially overlay the inner surface of the base and the inner surface of the sidewall; and a handle portion attached to said non-selfsupporting surface and defining a handle opening sized to receive the handle of the cookware in said handle opening.

2. The protective cover of claim 1, wherein said non-selfsupporting surface conforms to a configuration of the inner surface of the base and the inner surface of the sidewall of the cookware.

3. The protective cover of claim 1, wherein said non-selfsupporting surface is fabricated from a material selected from the group consisting of cloth, linen, soft woven fabrics, plastic, rubber, cotton, terry cloth, velvet, and tarnish resistant materials.

4. The protective cover of claim 1, wherein said handle portion is integrally formed with said non-selfsupporting surface.

5. The protective cover of claim 1, further comprising an additional handle portion that defines an additional handle opening for receiving an additional handle that extends from the outer surface of the sidewall of the cookware.

6. The protective cover of claim 1, wherein said non-selfsupporting surface includes an identifying marking thereon.

7. Cookware of the type having a base with an inner surface and a sidewall extending from the base, the sidewall having an inner surface, an outer surface and defining a cookware opening, the sidewall having a handle extending outwardly from the outer surface thereof, wherein the improvement comprises:

a protective cover for the cookware, said protective cover comprising:

a non-selfsupporting surface sized to substantially overlay the inner surface of the base and the inner surface of the sidewall; and a handle portion attached to said non-selfsupporting surface and defining a handle opening sized to receive the handle.

8. The protective cover of claim 7, wherein said non-selfsupporting surface conforms to a configuration of the inner surface of the base and the inner surface of the sidewall of the cookware.

9. The protective cover of claim 7, wherein:

said non-selfsupporting surface is fabricated from a material selected from the group consisting of cloth, linen, soft woven fabrics, plastic, cotton, terry cloth, velvet, and tarnish resistant materials; and said non-selfsupporting surface includes a non-slip surface attached to or integrally formed therewith.

10. The protective cover of claim 7, wherein said handle portion is integrally formed with said non-selfsupporting surface.

11. The protective cover of claim 7, further comprising an additional handle portion that defines an additional handle opening for receiving an additional handle that extends from the outer surface of the sidewall of the cookware.

12. A protective cover for cookware having a continuous inner surface and a handle extending from an outer surface of the cookware, the protective cover comprising:

a non-selfsupporting surface sized to substantially overlay the continuous inner surface of the cookware; and a handle portion attached to said non-selfsupporting surface and defining a handle opening sized to receive the handle of the cookware in said handle opening.

* * * * *